US012158045B2

(12) United States Patent
Guerra et al.

(10) Patent No.: US 12,158,045 B2
(45) Date of Patent: Dec. 3, 2024

(54) COUNTERBALANCE SYSTEMS AND RELATED METHODS FOR CATWALK SYSTEMS

(71) Applicant: FORUM US, INC., Houston, TX (US)

(72) Inventors: Gerardo Guerra, Spring, TX (US); Jesse Goerlich, Tomball, TX (US)

(73) Assignee: FORUM US, INC., Houston, TX (US)

( * ) Notice: Subject to any disclaimer, the term of this patent is extended or adjusted under 35 U.S.C. 154(b) by 5 days.

(21) Appl. No.: 18/295,905

(22) Filed: Apr. 5, 2023

(65) Prior Publication Data

US 2024/0337164 A1 Oct. 10, 2024

(51) Int. Cl.
*E21B 19/087* (2006.01)
*E21B 19/084* (2006.01)
*E21B 19/089* (2006.01)

(52) U.S. Cl.
CPC ..... *E21B 19/087* (2013.01); *E21B 19/084* (2013.01); *E21B 19/089* (2013.01)

(58) Field of Classification Search
CPC ..... E21B 19/087; E21B 19/084; E21B 19/089
See application file for complete search history.

(56) References Cited

U.S. PATENT DOCUMENTS 3,716,149 A * 2/1973 Scaggs ..... E21B 19/155 414/22.52
4,081,087 A * 3/1978 Freeman, Sr. ..... E21B 19/155 414/22.52
4,082,193 A * 4/1978 Teague ..... E21B 19/155 414/22.52
4,403,898 A * 9/1983 Thompson ..... E21B 19/155 414/22.58
7,832,974 B2 11/2010 Fikowski et al.
9,845,646 B2 * 12/2017 Dahmes ..... E21B 19/155
10,012,039 B2 7/2018 Guerra et al.
10,627,105 B2 * 4/2020 Higgins ..... F23G 5/002
11,549,320 B2 * 1/2023 Taggart ..... E21B 19/155
2006/0285941 A1 * 12/2006 Fikowski ..... E21B 19/155 414/22.54
2011/0044787 A1 2/2011 Fikowski et al.
2011/0259640 A1 * 10/2011 Gerber ..... E21B 19/14 175/52
2014/0286732 A1 * 9/2014 Swanson ..... E21B 19/15 414/800

(Continued)

FOREIGN PATENT DOCUMENTS

WO 2006128300 A1 12/2006

*Primary Examiner* — Taras P Bemko
(74) *Attorney, Agent, or Firm* — Patterson + Sheridan, LLP

(57) ABSTRACT

Aspects of the disclosure relate to counterbalance systems for catwalk systems, and related methods. A counterbalance system pulls a trough of a catwalk system while actuating the catwalk system. A catwalk system includes a chassis, a main arm pivotably coupled to the chassis, a trough pivotably coupled to the chassis and having one or more rollers, a V-door ramp pivotably coupled to the chassis, and a counterbalance system coupled to the trough at a coupling point. The counterbalance system includes a first sheave suspended from the V-door ramp, a second sheave suspended from the first sheave, and a counterbalance rope wound at least partially about the first sheave and the second sheave. A first end of the counterbalance rope is coupled to the trough at the coupling point.

21 Claims, 17 Drawing Sheets

(56) References Cited

U.S. PATENT DOCUMENTS

| | | | | |
|---|---|---|---|---|
| 2016/0376848 | A1* | 12/2016 | Taraldrud | E21B 19/02<br>166/355 |
| 2017/0234088 | A1 | 8/2017 | Orr et al. | |
| 2017/0327321 | A1* | 11/2017 | Sherbeck | B65G 35/00 |
| 2018/0179834 | A1* | 6/2018 | Gordon | E21B 19/20 |
| 2018/0363421 | A1* | 12/2018 | Harshbarger | E21B 41/00 |
| 2020/0141194 | A1* | 5/2020 | Friestad | E21B 19/06 |
| 2021/0222519 | A1 | 7/2021 | Rosano et al. | |
| 2022/0003055 | A1* | 1/2022 | Petrello | E21B 19/087 |

* cited by examiner

COUNTERBALANCE SYSTEMS AND RELATED METHODS FOR CATWALK SYSTEMS

BACKGROUND

Field

Aspects of the disclosure relate to counterbalance systems for catwalk systems, and related methods. In one aspect, a counterbalance system assists a trough of a catwalk system while actuating the catwalk system.

Description of the Related Art

Catwalk systems can involve inefficiencies and operational constraints. For example, actuation of catwalk systems can involve substantial expenditures of power. The expenditures of power not only cause cost increases but also limit operations and cause delays by limiting the power that can be expended for other operations at a wellsite. As another example, the power needed to actuate catwalks can vary from catwalk system to catwalk system, causing operational delays and limited modularity of actuation. Such constraints can be exacerbated by wellsite conditions that can vary from wellsite to wellsite.

Therefore, there is a need for catwalk systems that save power and cost, simply and efficiently open up availability of power for other wellsite operations, actuate in a modular fashion, and reduce operational delays.

SUMMARY

Aspects of the disclosure relate to counterbalance systems for catwalk systems, and related methods. In one aspect, a counterbalance system pulls a trough of a catwalk system while actuating the catwalk system.

In one aspect, a catwalk system comprises a chassis; a main arm pivotably coupled to the chassis; a trough pivotably coupled to the main arm; a V-door ramp pivotably coupled to the chassis; and a counterbalance system coupled to the trough at a coupling point, the counterbalance system comprising: a first sheave suspended from the V-door ramp, a second sheave suspended from the first sheave, and a counterbalance rope wound at least partially about the first sheave and the second sheave, a first end of the counterbalance rope coupled to the trough at the coupling point.

In one aspect, a method of deploying a catwalk system at a wellsite, comprises engaging a rig structure with a V-door ramp, the V-door ramp coupled to a counterbalance system comprising: a first sheave suspended from the V-door ramp, a second sheave suspended from the first sheave, and a counterbalance rope wound at least partially about the first sheave and the second sheave, a first end of the counterbalance rope coupled to a trough at a coupling point; actuating a main arm to slide the trough upward and along the V-door ramp toward the rig structure; pulling the trough upward using the first end of the counterbalance rope while actuating the main arm; positioning an outer end of the trough adjacent a platform of the rig structure; and pulling the trough downward using the first end of the counterbalance rope.

In one aspect, a catwalk system comprises a chassis; a main arm pivotably coupled to the chassis; a trough pivotably coupled to the main arm; a V-door ramp pivotably coupled to the chassis; and a counterbalance system coupled to the trough at a coupling point, the counterbalance system comprising: an accumulator fluidly coupled to one or more hydraulic cylinders configured to rotate the main arm to move the trough along the V-door ramp, wherein when the trough is lowered downward along the V-door ramp, hydraulic fluid is supplied from the hydraulic cylinders to the accumulator, which compresses a gas in the accumulator, and wherein a force of the compressed gas helps supply the hydraulic fluid back to the hydraulic cylinders to raise the trough.

In one aspect, a catwalk system comprises a chassis; a main arm pivotably coupled to the chassis; a trough pivotably coupled to the main arm; a V-door ramp pivotably coupled to the chassis; and a counterbalance system coupled to the trough at a coupling point, the counterbalance system comprising: a plurality of sheaves; a counterbalance rope wound at least partially about the plurality of sheaves, wherein a first end of the counterbalance rope is coupled to the trough, wherein a second end of the counterbalance rope is coupled to a top drive system and wound about a drawworks system configured to raise and lower the top drive system, and wherein when the top drive system is lowered, the trough is moved upward along the V-door ramp such that the weight of the top drive system acts as a counterbalance force to help pull the trough upward along the V-door ramp.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
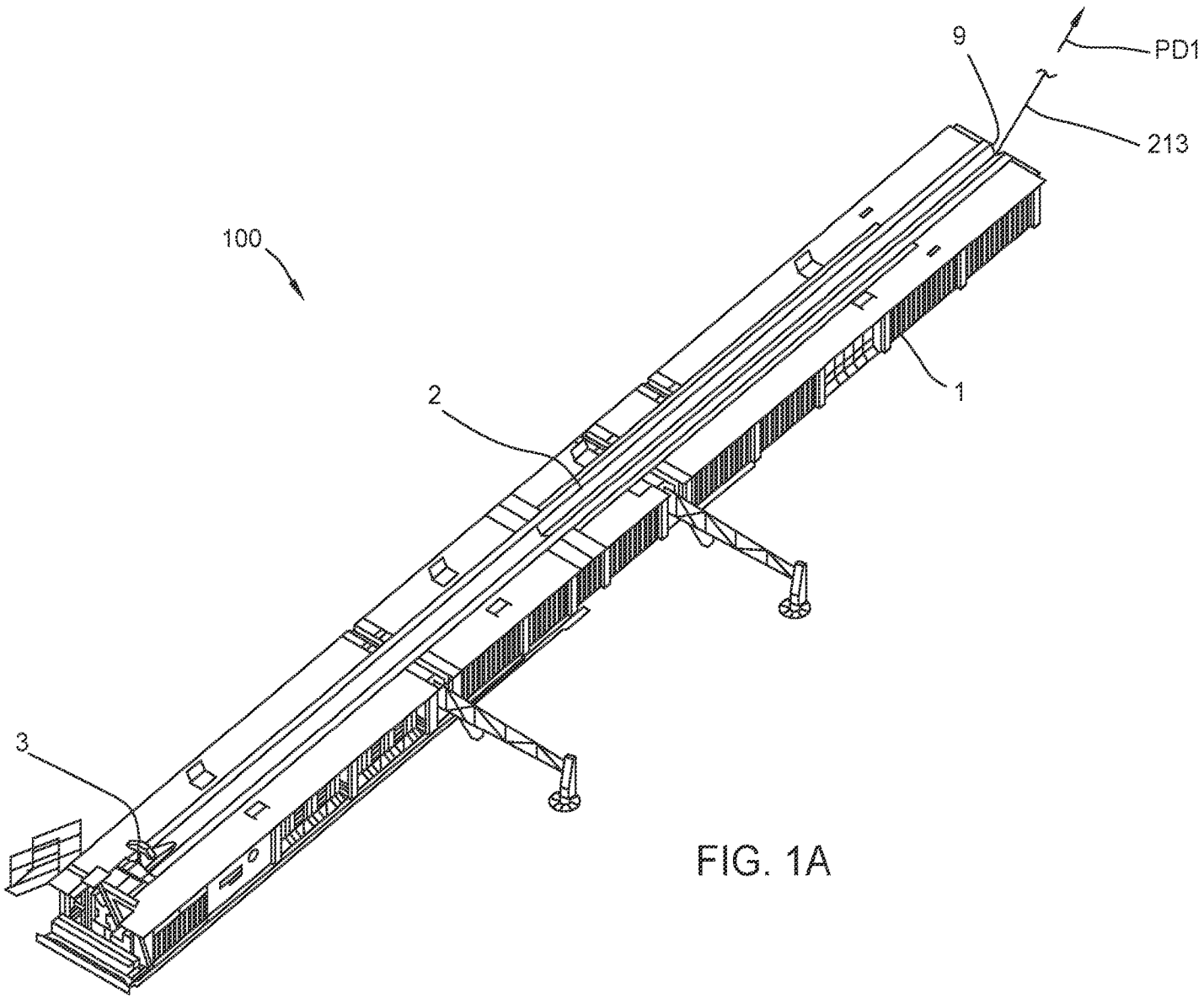
FIG. 1A is a partial schematic isometric view of a catwalk system, according to one implementation.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the disclosure relate to counterbalance systems for catwalk systems, and related methods. In one aspect, a counterbalance system moves a trough of a catwalk system while actuating the catwalk system.

The disclosure contemplates that terms such as "couples," "coupling," "couple," and "coupled" may include but are not limited to welding, interference fitting, and/or fastening such as by using bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

FIG. 1A is a partial schematic isometric view of a catwalk system 100, according to one implementation. The catwalk system 100 is shown in a retracted position in FIG. 1A, where a trough 2 of the catwalk system 100 is lowered and resting on a chassis 1.

The catwalk system 100 is used to convey pipe to a deck, such as a drill floor, of a rig structure. Pipe is loaded into the trough 2 so that a skate 3 may push pipe along the trough 2 and toward the deck of the rig structure. A counterbalance rope 213 of a counterbalance system 210 (illustrated in FIGS. 2A-2C) is coupled to the trough 2. In the retracted position, the counterbalance rope 213 pulls upwardly on the trough 2. The counterbalance rope 213 pulls on the trough 2 in a pulling direction PD1 that has an upward vertical vector and a horizontal vector that extends away from an outer end 9 of the trough 2.

Figure 1B:
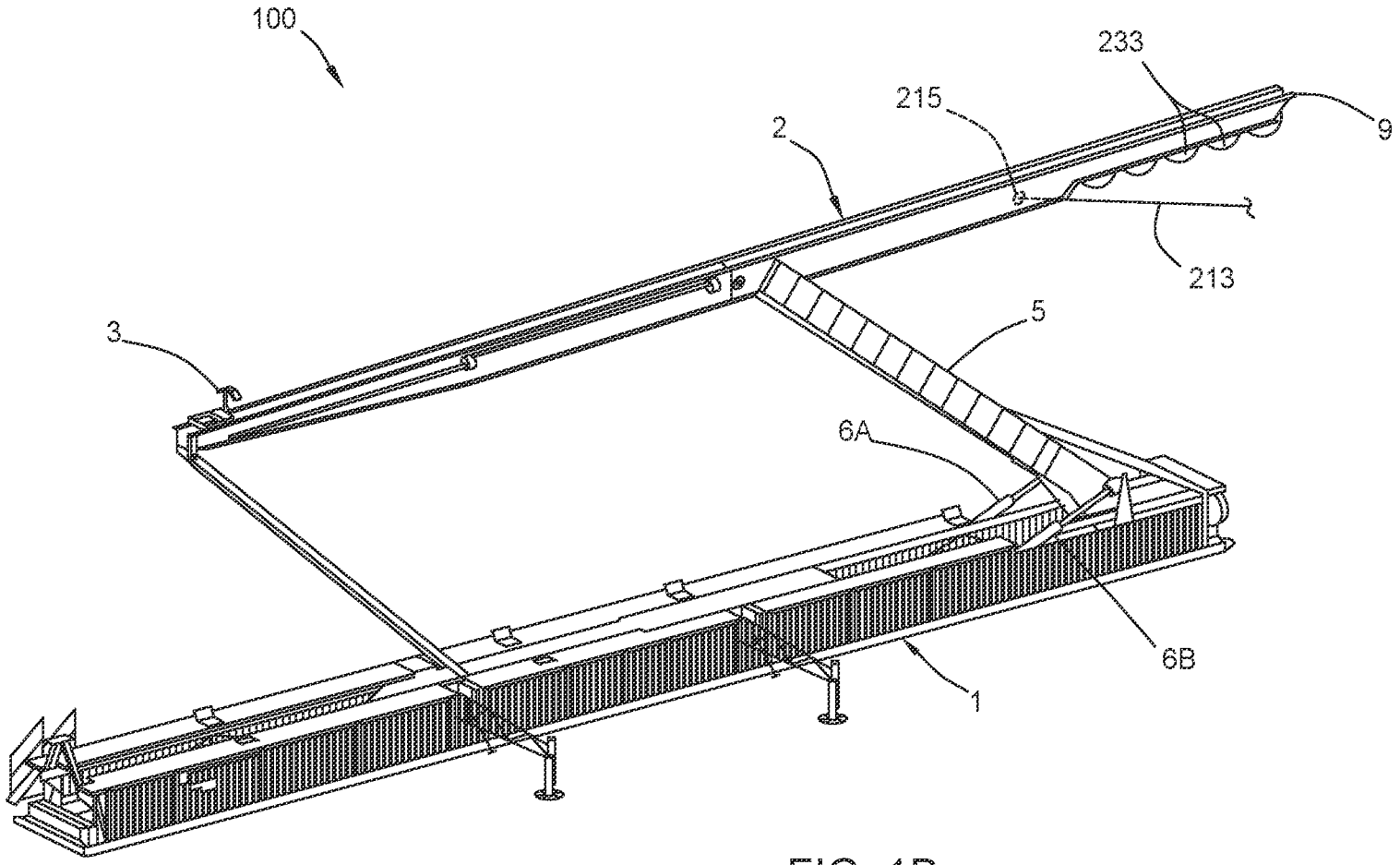
FIG. 1B is a partial schematic isometric view of the catwalk system shown in FIG. 1A, according to one implementation.

FIG. 1B is a partial schematic isometric view of the catwalk system 100 shown in FIG. 1A, according to one implementation. The catwalk system 100 is shown in an intermediate position in FIG. 1B while being actuated to an extended position. While actuated, the catwalk system 100 raises the trough 2 toward the deck of the rig structure using a main arm 5 that is actuated (e.g., raised) using hydraulic cylinders 6A, 6B. The main arm 5 may be in the form of a beam, a leg, and/or other support type member. The trough 2 includes one or more trough rollers 233. A plurality of trough rollers 233 are shown that roll along a V-door ramp 207 (illustrated in FIG. 2A) as the trough 2 is actuated into the extended position. Instead of or in addition to the hydraulic cylinders 6A, 6B, winches, sheaves, and/or wire ropes can be used to actuate (e.g., lift) the main arm 5 and the trough 2 to the extended position.

Figure 1C:
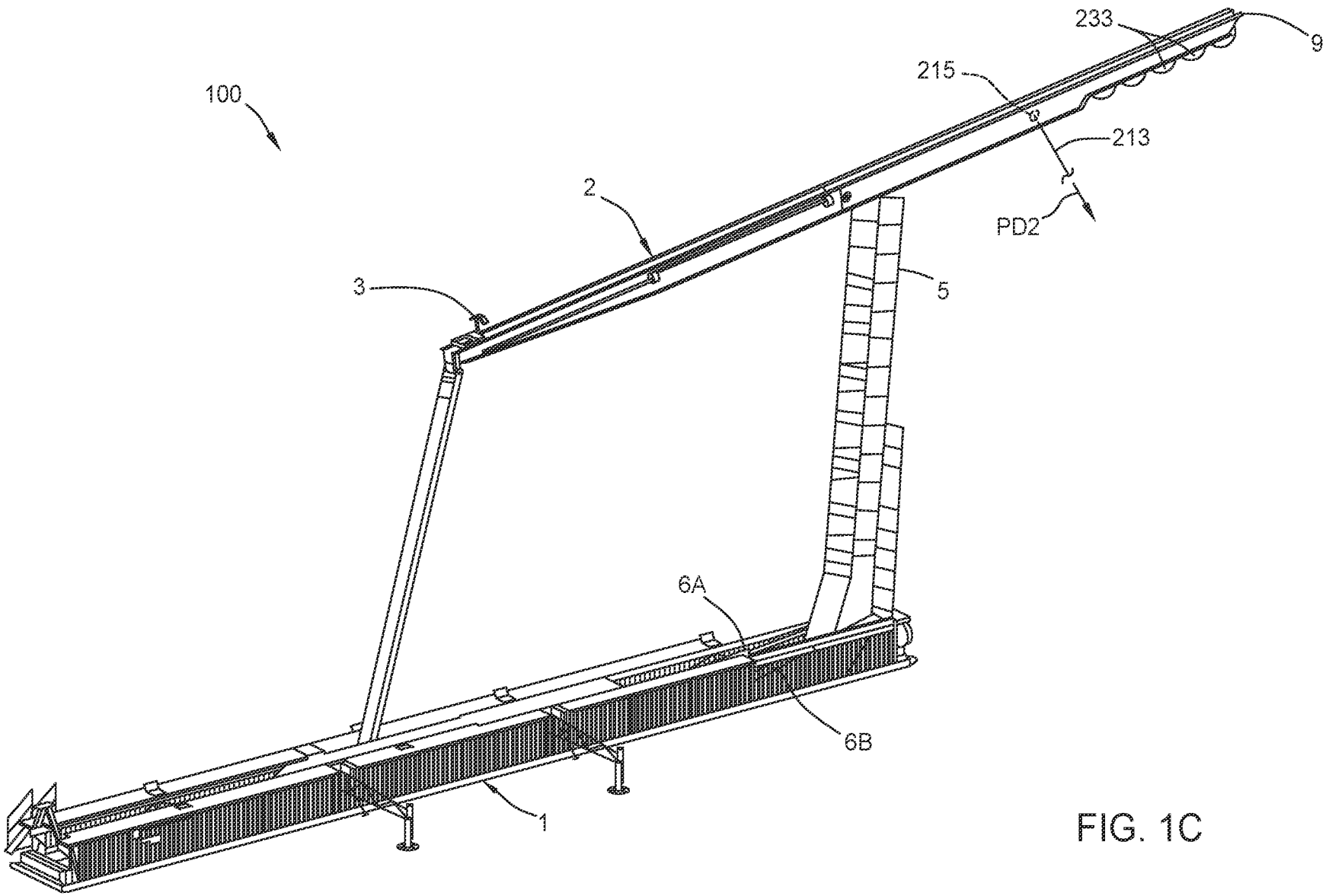
FIG. 1C is a partial schematic isometric view of the catwalk system shown in FIGS. 1A and 1B, according to one implementation.

FIG. 1C is a partial schematic isometric view of the catwalk system 100 shown in FIGS. 1A and 1B, according to one implementation. In FIG. 1C, the catwalk system 100 is shown actuated into the extended position where the outer end 9 of the trough 2 is adjacent to and above the deck of the rig structure. The counterbalance rope 213 pulls on the trough 2 in a pulling direction PD2 that has a downward vertical vector and a horizontal vector that extends away from the main arm 5. The skate 3 is used to move pipe to the outer end 9 of the trough 2 so that the pipe can be removed (e.g., lifted) from the trough 2 by the crew on the deck and moved toward a rotary or into a setback area on the deck. The pipe can be joined with other pipe to form a drill string and lowered into a wellbore from the deck of the rig structure.

Figure 2A:
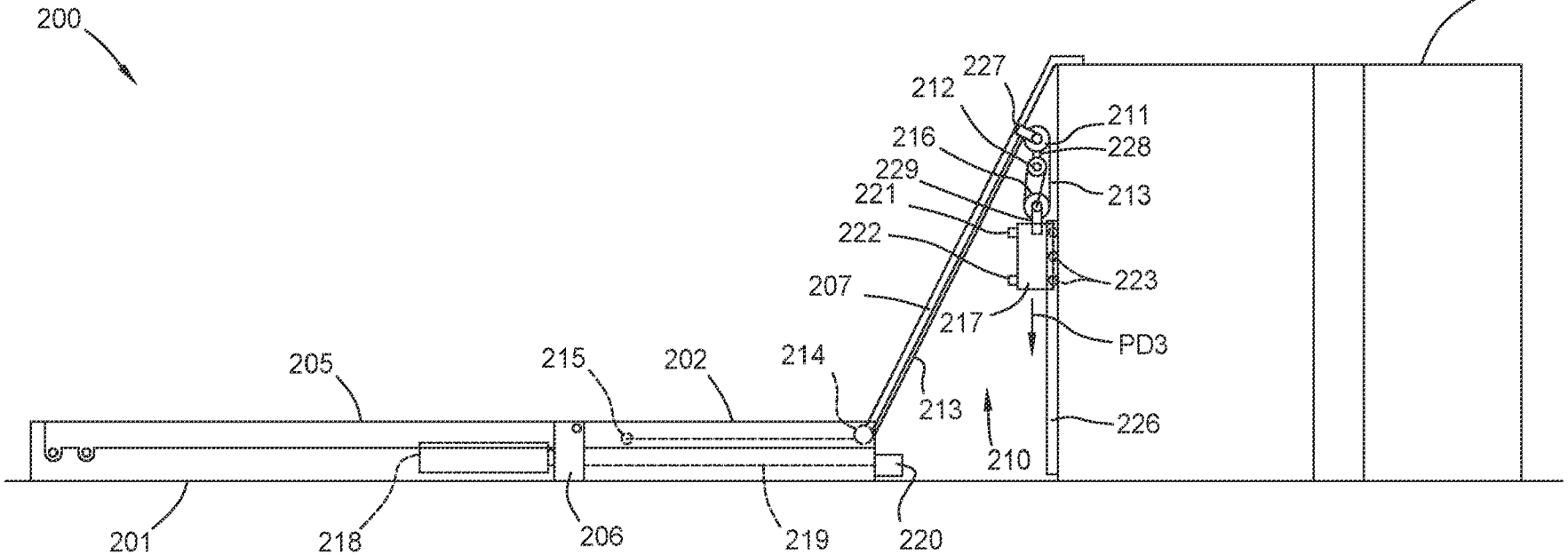
FIG. 2A is a partial schematic side view of a catwalk system, according to one implementation.

FIG. 2A is a partial schematic side view of a catwalk system 200, according to one implementation. The catwalk system 200 is shown in a retracted position in FIG. 2A. The catwalk system 200 is configured to raise and lower pipe to and from a rig structure 225.

The catwalk system 200 includes a chassis 201, a main arm 205 pivotably coupled to the chassis 201, and a trough 202 pivotably coupled to the chassis 201 and/or the main arm 205. The main arm 205 is pivotably coupled to the chassis 201 through a slider block 206 to which the main arm 205 is pivotably coupled. The catwalk system 200 includes a V-door ramp 207 pivotably coupled to the chassis 201. The V-door ramp 207 is shown leaning against the rig structure 225.

The catwalk system 200 includes a counterbalance system 210 coupled to the trough 202 at a coupling point 215. The counterbalance system 210 includes a first sheave 211 suspended from the V-door ramp 207, and a second sheave 212 suspended from the first sheave 211. The counterbalance system 210 includes the counterbalance rope 213 wound at least partially about the first sheave 211 and the second sheave 212. A first end of the counterbalance rope 213 is coupled to the trough 202 at the coupling point 215. The counterbalance system 210 includes a trough sheave 214 disposed within the trough 202 between the coupling point 215 and an outer end 209 (shown in FIG. 2B) of the trough 202.

Figure 2B:
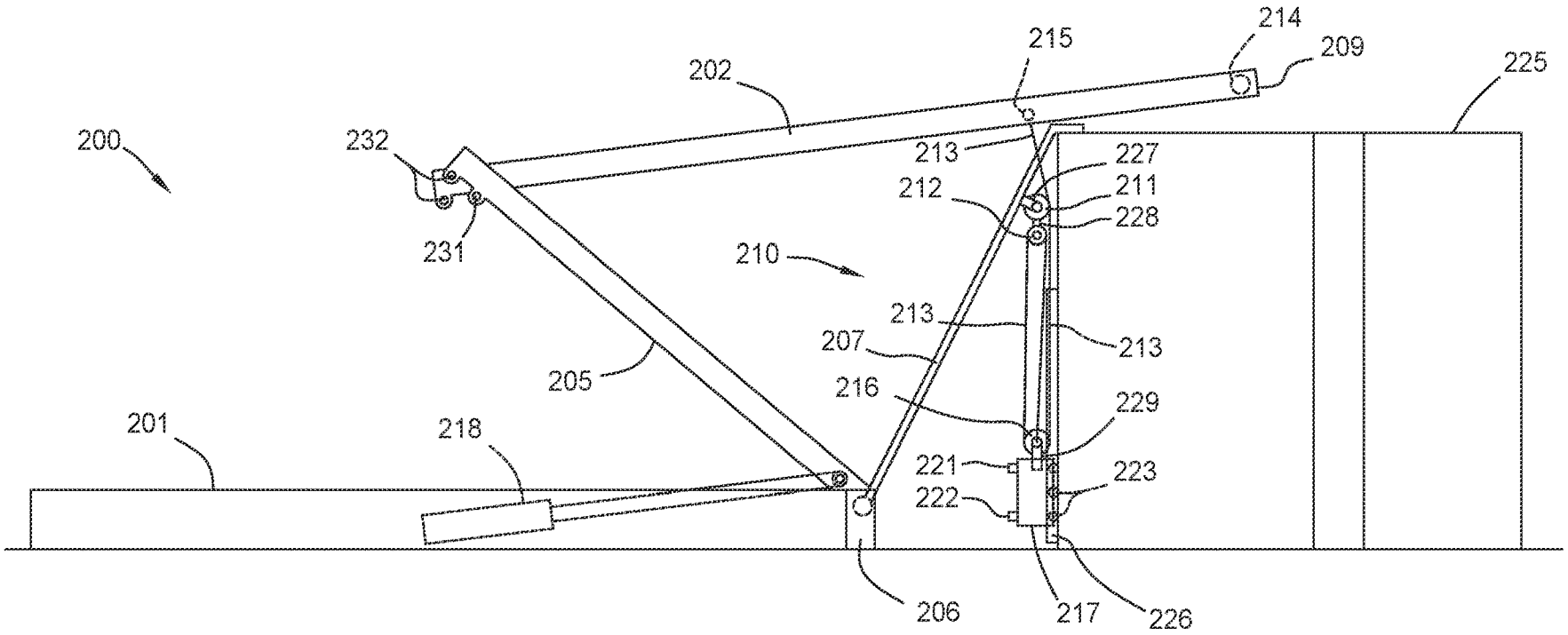
FIG. 2B is a partial schematic side view of the catwalk system shown in FIG. 2A, according to one implementation.

Actuation of the catwalk system 200 can include actuation of one or more hydraulic cylinders 218 coupled to the slider block 206 to move the slider block 206 toward an end of the chassis 201. The trough 202 slides along the V-door ramp 207 (such as by using the trough rollers 233 shown in FIGS. 1B and 1C) as the slider block 206 moves. In one embodiment, which can be combined with other embodiments, the slider block 206 slides along the chassis 201 until the slider block 206 abuts against an end portion of the chassis 201 as shown in FIG. 2B. Upon the slider block 206 abutting against the end portion of the chassis 201, the main arm 205 begins to pivot away from the chassis 201 with further actuation of the main arm 205 by the hydraulic cylinders 218. A wire rope 219 can be used, in addition to or in place of the one or more hydraulic cylinders 218, to move the slider block 206, the main arm 205, and the trough 202. One or more winches 220 can be coupled to the wire rope 219 to pay the wire rope 219 in and out to move the slider block 206, the main arm 205, and the trough 202. Although the catwalk system 200, and specifically the main arm 205 and/or the trough 202, is illustrated as being actuated by hydraulic cylinders 218 and/or winches 220 via wire rope 219, other actuation systems can be used to actuate any component of the catwalk system 200. For example, hydraulic, pneumatic, mechanical, and/or electrical actuation type systems can be used to raise and lower the main arm 205 and/or the trough 202. Additional examples may include, but are not limited to, using a winch system that is connected directly to one or more components of the catwalk system 200 or connected indirectly through one or more components of the counterbalance system 210. These examples of various actuation systems may equally apply to any one of the various catwalk systems and counterbalance systems further disclosed herein.

The counterbalance system 210 includes a third sheave 216 coupled to and suspended from a second end of the counterbalance rope 213, and a counterweight 217 suspended from the third sheave 216 to force the second end of the counterbalance rope 213 in a pulling direction PD3. In one embodiment, the counterweight 217 includes a tank that is formed of steel plates welded together. In one embodiment, which can be combined with other embodiments, the tank has a width of about 4 feet, a length of about 4 feet, and a height of about 6.25 feet. The tank includes an internal volume and one or more fluid conduits 221, 222 configured to direct fluid into and out of the internal volume of the tank of the counterweight 217. An inlet conduit 221 fills the internal volume of the counterweight 217 with the fluid, and an outlet conduit 222 drains the fluid from the internal volume of the counterweight 217. The counterweight 217 can include concrete and/or steel plates coupled together (such as by stacking the plates on each other, welding the plates together, and/or otherwise pinning, linking, and/or placing the plates together), and can be used without the internal volume and/or without the fluid.

The counterbalance system 210 includes one or more counterweight rollers 223 configured to interface between the counterweight 217 and the rig structure 225. A track 226 is coupled to the rig structure 225 to retain the counterweight 217 as the counterweight 217 moves upward and downward along the track 226. In an alternative embodiment, the track 226 may be separate and apart from the rig structure 225 and is not coupled to the rig structure 225. In an alternative embodiment, the track 226 may not be needed and the counterweight 217 can freely hang from the first, second, and/or third sheaves 211, 212, 216. If the track 226 is used, an interference fit, or another type of connection, between the track 226 and the counterweight 217 can be used to retain the counterweight 217 along the track 226. The counterweight rollers 223 roll as the counterweight 217 translates along the track 226. In one embodiment, which can be combined with other embodiments, the interference fit includes one or more flanges of the counterweight 217 that engage one or more flanges of the track 226.

In the retracted position, the counterweight 217 pulls on the counterbalance rope 213, which in turn pulls on the trough 202 to reduce the required force (such as the actuation force applied by the hydraulic cylinders 6A, 6B) needed to actuate the trough 202 to the extended position. By reducing the actuation force needed for actuation, the counterbalance system 210 reduces power consumption to thereby reduce costs and allow increased electrical power to simultaneously be used for other operations at the wellsite. Simultaneously using electrical power for a variety of operations at a wellsite enhances efficiency and reduces operational delays, which can further reduce costs.

A first link 227 couples the first sheave 211 to the V-door ramp 207, a second link 228 couples the second sheave 212 to the first sheave 211, and a third link 229 couples the counterweight 217 to the third sheave 216. The second link 228 is pivotable relative to the first sheave 211 and the second sheave 212. The third link 229 is pivotable relative to the third sheave 216.

FIG. 2B is a partial schematic side view of the catwalk system 200 shown in FIG. 2A, according to one implementation. The catwalk system 200 is shown in the extended position in FIG. 2B. In the extended position, the counterweight 217 translates along the track 226 to a lower position of the counterweight 217. The counterweight 217 uses potential energy (influenced by gravity) to assist in actuating the catwalk system 200 to the extended position, specifically raising the trough 202 and any pipe that is being supported on the trough 202, thereby reducing the power expenditure needed to actuate the catwalk system 200 to the extended position.

The catwalk system 200 is configured such that the outer end 209 of the trough 202 is above a height H1 of the deck of the rig structure 225. In the implementation shown in FIG. 2B, the height H1 is 25 feet and a first pin position 231 is used to pivotably couple the trough 202 to the main arm 205. In one embodiment, which can be combined with other embodiments, a second pin position 232 is used to pivotably couple the trough 202 to the main arm 205 for a height H1 of 40 feet or larger. The present disclosure contemplates that other heights H1 may be used for the catwalk system 200. In one embodiment, which can be combined with other embodiments, the main arm 205 and the trough 202 are configured to support a weight capacity of 10,000 pounds or more, such as 16,000 pounds. In one embodiment, which can be combined with other embodiments, the V-door ramp 207 is configured to support a weight capacity of 10,000 pounds or more, such as 16,000 pounds. The present disclosure contemplates that other weight capacities may be used for the catwalk system 200.

Figure 3:
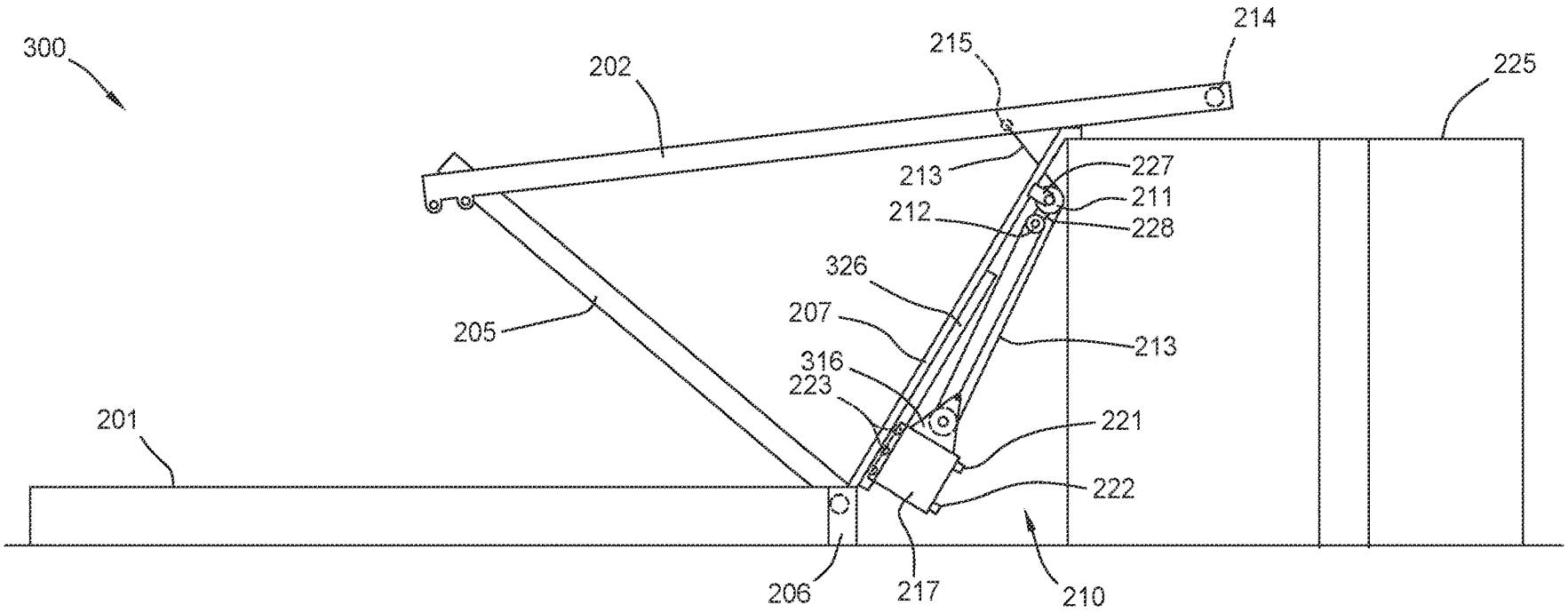
FIG. 3 is a partial schematic side view of a catwalk system, according to one implementation.

FIG. 3 is a partial schematic side view of a catwalk system 300, according to one implementation. The catwalk system 300 is shown in the extended position in FIG. 3. The catwalk system 300 is similar to the catwalk system 200 shown in FIGS. 2A and 2B and includes one or more of the aspects, features, components, and/or properties thereof.

In the implementation shown in FIG. 3, a third sheave 316 includes a pair of triangular padeyes coupled to the counterweight 217. A track 326 is coupled to the V-door ramp 207 to retain the counterweight 217 as the counterweight 217 moves upward and downward along the track 326. The track 326 is similar to the track 226 shown in FIGS. 2A and 2B and includes one or more of the aspects, features, components, and/or properties thereof. In the implementation shown in FIG. 3, the counterweight 217 moves at an angle (relative to a vertical axis) along the track 326.

Figure 4A:
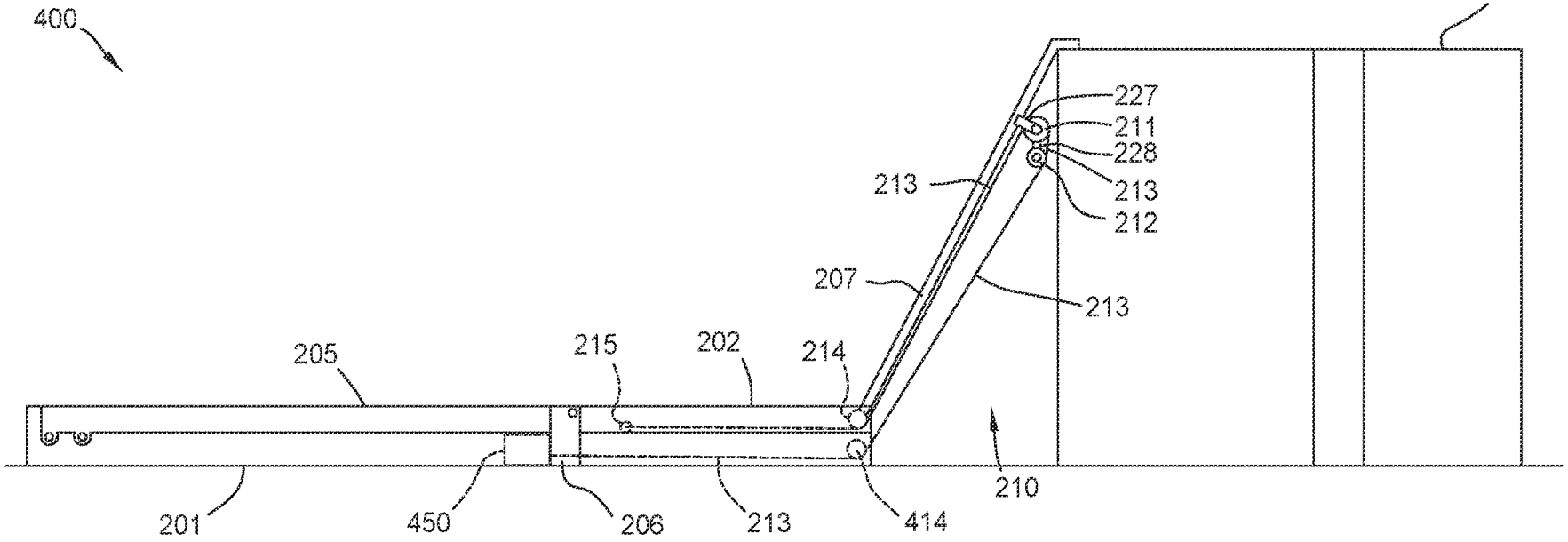
FIG. 4A is a partial schematic side view of a catwalk system, according to one implementation.
Figure 4B:
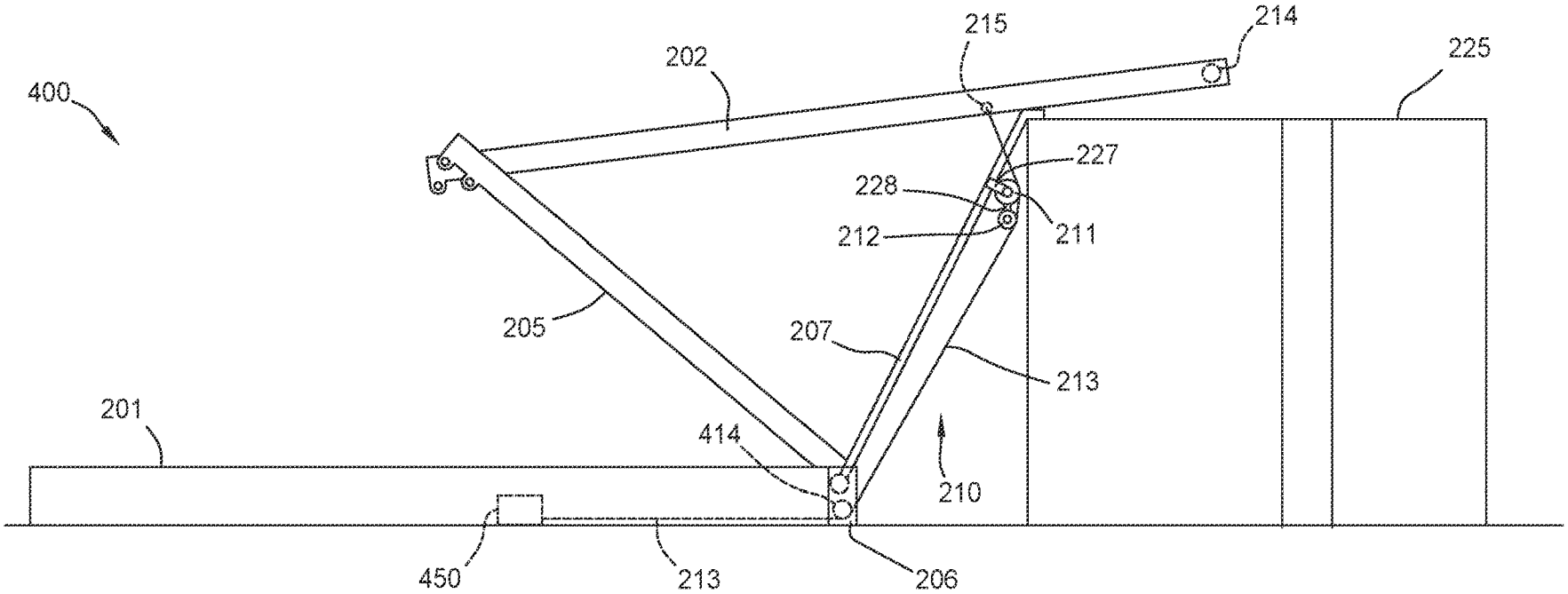
FIG. 4B is a partial schematic side view of the catwalk system shown in FIG. 4A, according to one implementation.

FIG. 4A is a partial schematic side view of a catwalk system 400, according to one implementation. The catwalk system 400 is shown in the retracted position in FIG. 4A. The catwalk system 400 is similar to the catwalk system 200 shown in FIGS. 2A and 2B and includes one or more of the aspects, features, components, and/or properties thereof. FIG. 4B is a partial schematic side view of the catwalk system 400 shown in FIG. 4A, according to one implementation. The catwalk system 400 is shown in the extended position in FIG. 4B.

The catwalk system 400 includes a chassis roller 414 disposed within the chassis 201, and a biasing system 450 disposed within the chassis 201. The biasing system 450 may form part of any of the embodiments of the counter balance systems described herein. The second end of the counterbalance rope 213 is coupled to the biasing system 450.

Figure 5A:
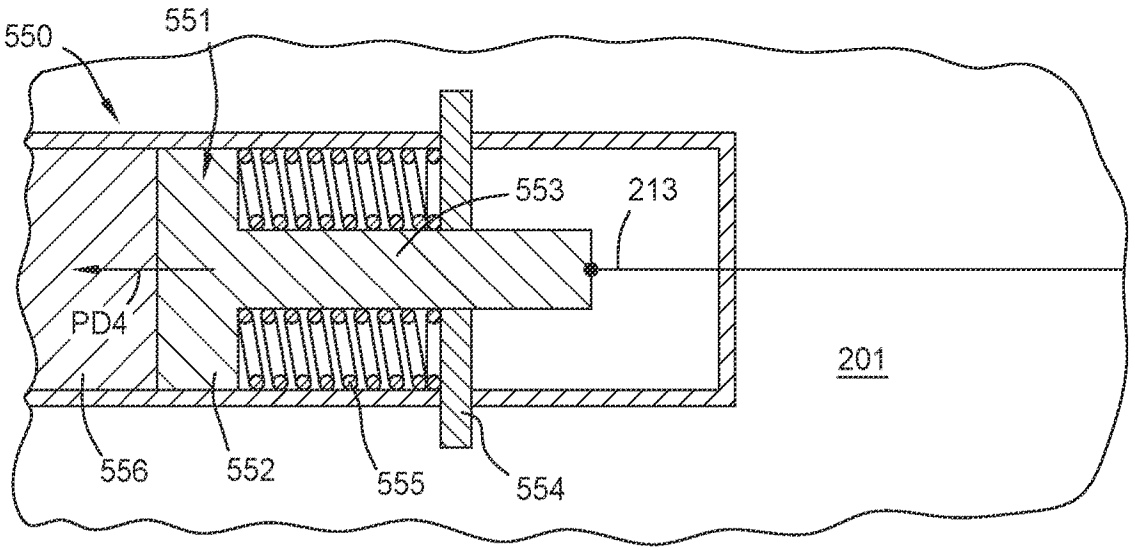
FIG. 5A is a schematic side view of a biasing system, according to one implementation.

FIG. 5A is a schematic side view of a biasing system 550, according to one implementation. The biasing system 550 can be used as the biasing system 450 shown in FIGS. 4A and 4B. The biasing system 550 is shown while the catwalk system 400 is in the retracted position in FIG. 5A. While the catwalk system 400 is in the retracted position, the one or more springs 555 are in a compressed position.

The biasing system 550 includes a piston 551, one or more springs 555 (one is shown), and a locking ring 554 disposed within the chassis 201. The one or more springs 555 are positioned between a piston head 552 of the piston 551 and the locking ring 554. The second end of the counterbalance rope 213 is coupled to a piston rod 553 of the piston 551. The second end of the counterbalance rope 213 can be coupled to the one or more springs 555. A movable block 556 interfaces with the piston head 552. In the retracted position of the catwalk system 400, the movable block 556 is positioned against the piston head 552 to compress the one or more springs 555 against the locking ring 554.

The one or more springs 555 are configured to bias the second end of the counterbalance rope 213 in a pulling direction PD4. As the catwalk system 400 is actuated out of the retracted position and toward the intermediate position, the movable block 556 moves in the pulling direction PD4 to allow the one or more springs 555 to bias (e.g., expand to push) the piston head 552 in the pulling direction PD4. The one or more springs 555 biasing the piston head 552 biases the second end of the counterbalance rope 213 to pull the counterbalance rope 213 in the pulling direction PD4. The pulling of the counterbalance rope 213 in the pulling direction PD4 pulls on the trough 202 in the pulling direction PD1 to facilitate actuating of the trough 202 toward the intermediate position and the extended position.

Figure 5B:
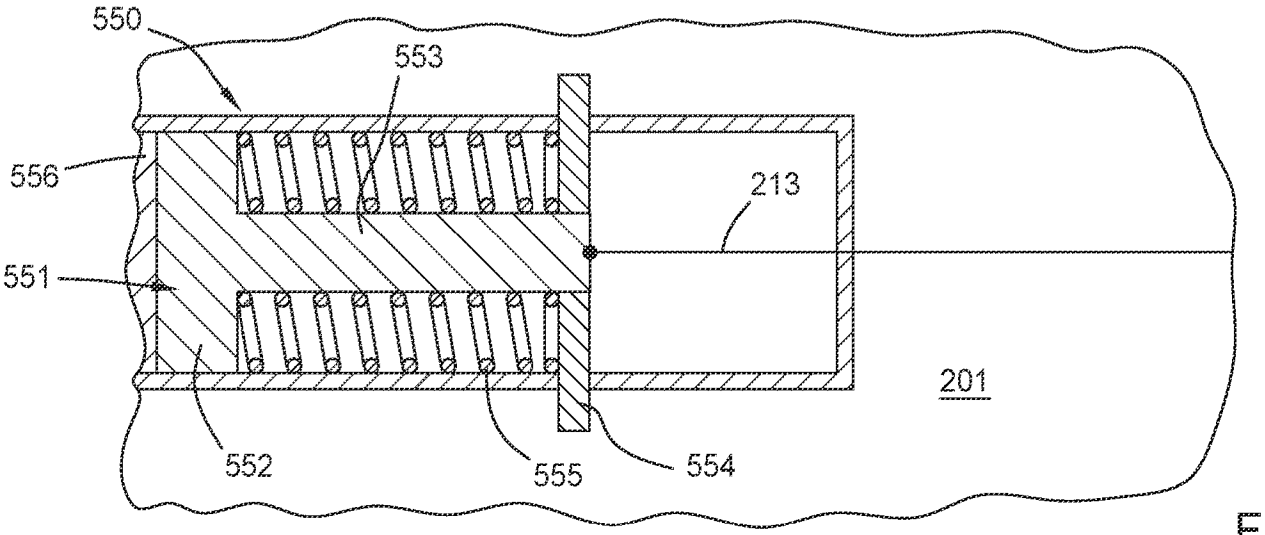
FIG. 5B is a schematic side view of the biasing system shown in FIG. 5A, according to one implementation.

FIG. 5B is a schematic side view of the biasing system 550 shown in FIG. 5A, according to one implementation. The biasing system 550 is shown while the catwalk system 400 is in the extended position in FIG. 5B.

While the catwalk system 400 is in the extended position, the one or more springs 555 are in an expanded position. During the retraction of the catwalk system 400 toward the retracted position, the movable block 556 pushes the piston head 552 to compress the one or more springs 555 back to the compressed position shown in FIG. 5A.

The biasing system 550 uses potential energy (stored in the one or more springs 555) to assist in actuating the catwalk system 400 to the extended position, thereby reducing the power expenditure needed to actuate the catwalk system 400 to the extended position.

Figure 6A:
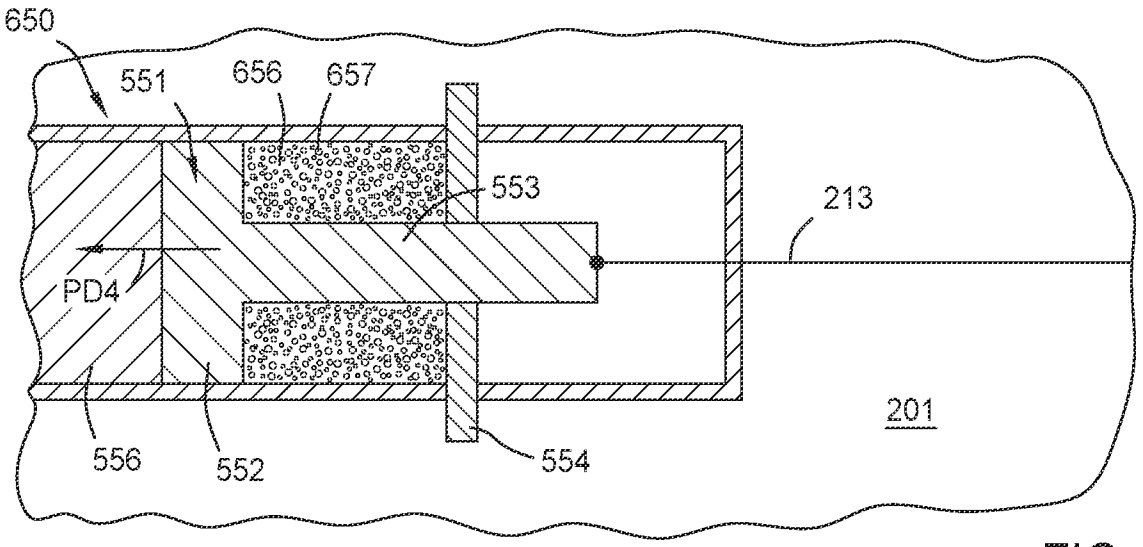
FIG. 6A is a schematic side view of a biasing system, according to one implementation.

FIG. 6A is a schematic side view of a biasing system 650, according to one implementation. The biasing system 650 can be used as the biasing system 450 shown in FIGS. 4A and 4B. The biasing system 650 is shown while the catwalk system 400 is in the retracted position in FIG. 6A. The biasing system 650 is similar to the biasing system 550 shown in FIGS. 5A and 5B and includes one or more of the aspects, features, components, and/or properties thereof.

The biasing system 650 is a damper system. The biasing system 650 includes a damper chamber 656 disposed within the chassis 201 and a compressible fluid 657 disposed in the damper chamber 656. The compressible fluid 657 interfaces with the piston head 552 of the piston 551. The piston 551 is a damper disposed in the damper chamber 656. The compressible fluid 657 is configured to expand to bias the second end of the counterbalance rope 213 in the pulling direction PD4.

While the catwalk system 400 is in the retracted position, the compressible fluid 657 is in a compressed position. A seal is formed between the piston rod 553 and the locking ring 554. As the catwalk system 400 is actuated out of the retracted position and toward the intermediate position, the movable block 556 moves in the pulling direction PD4 to allow the compressible fluid 657 to bias (e.g., expand to push) the piston head 552 in the pulling direction PD4. The compressible fluid 657 biasing the piston head 552 biases the second end of the counterbalance rope 213 to pull the counterbalance rope 213 in the pulling direction PD4.

Figure 6B:
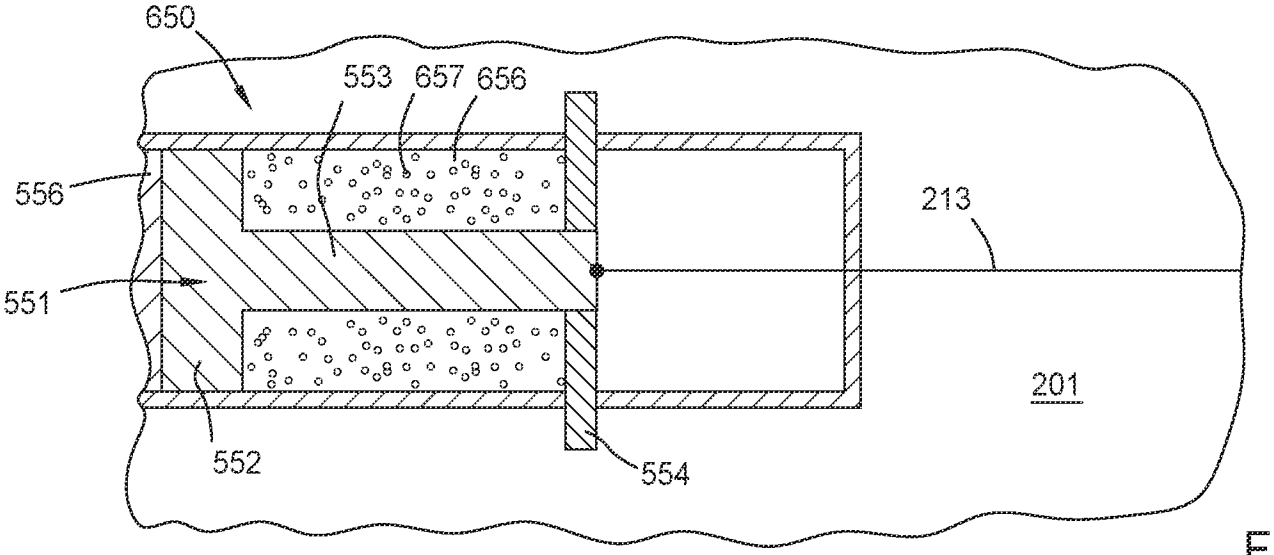
FIG. 6B is a schematic side view of the biasing system shown in FIG. 6A, according to one implementation.

FIG. 6B is a schematic side view of the biasing system 650 shown in FIG. 6A, according to one implementation. The biasing system 650 is shown while the catwalk system 400 is in the extended position in FIG. 6B.

While the catwalk system 400 is in the extended position, the compressible fluid 657 is in an expanded position. During the retraction of the catwalk system 400 toward the retracted position, the movable block 556 pushes the piston head 552 to compress the compressible fluid 657 back to the compressed position shown in FIG. 6A. The biasing system 650 uses potential energy (stored in the compressible fluid 657) to assist in actuating the catwalk system 400 to the extended position, thereby reducing the power expenditure needed to actuate the catwalk system 400 to the extended position.

Figure 7A:
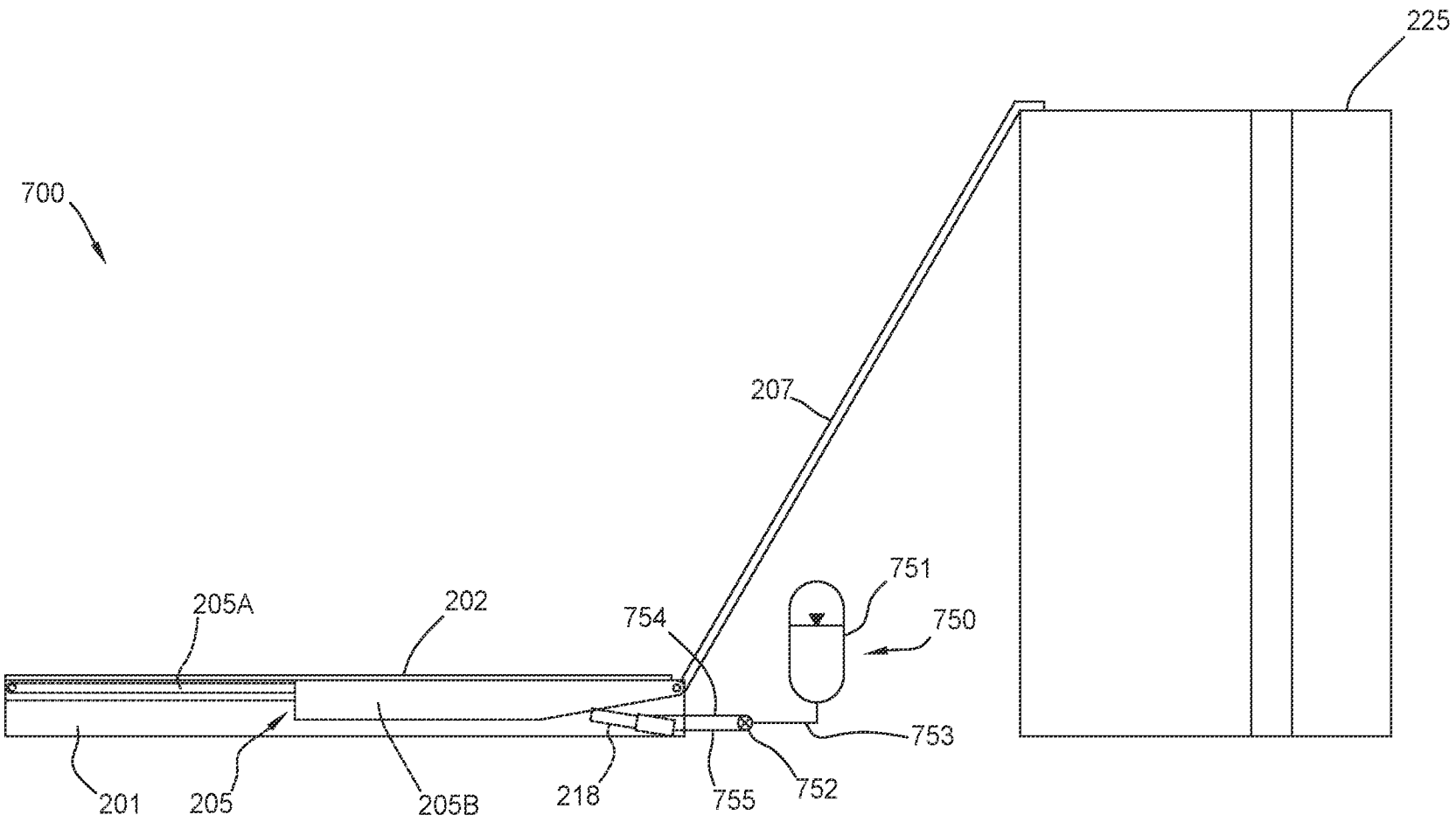
FIG. 7A is a partial schematic side view of a catwalk system, according to one implementation.
Figure 7B:
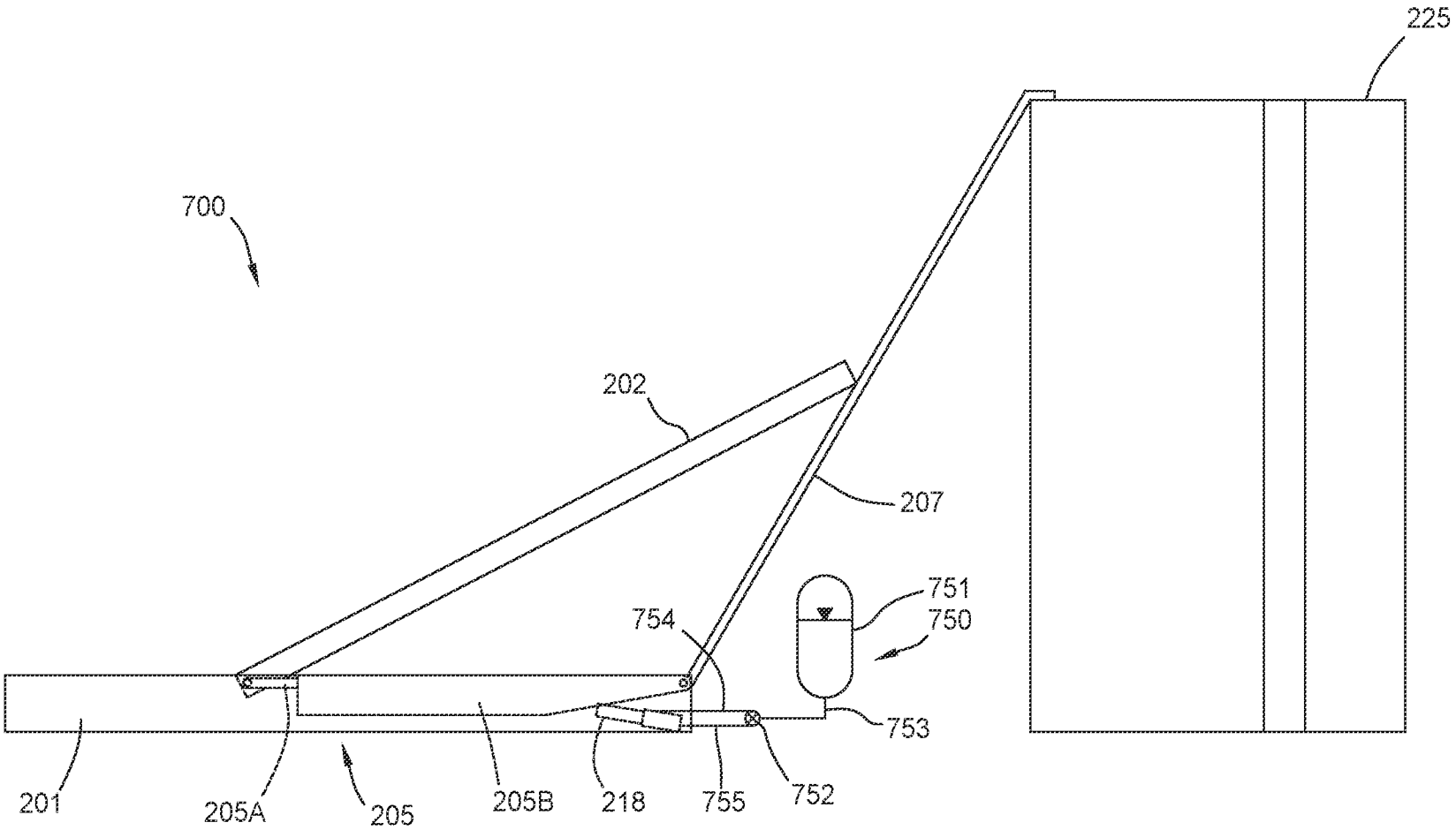
FIG. 7B is a partial schematic side view of the catwalk system shown in FIG. 7A, according to one implementation.
Figure 7C:
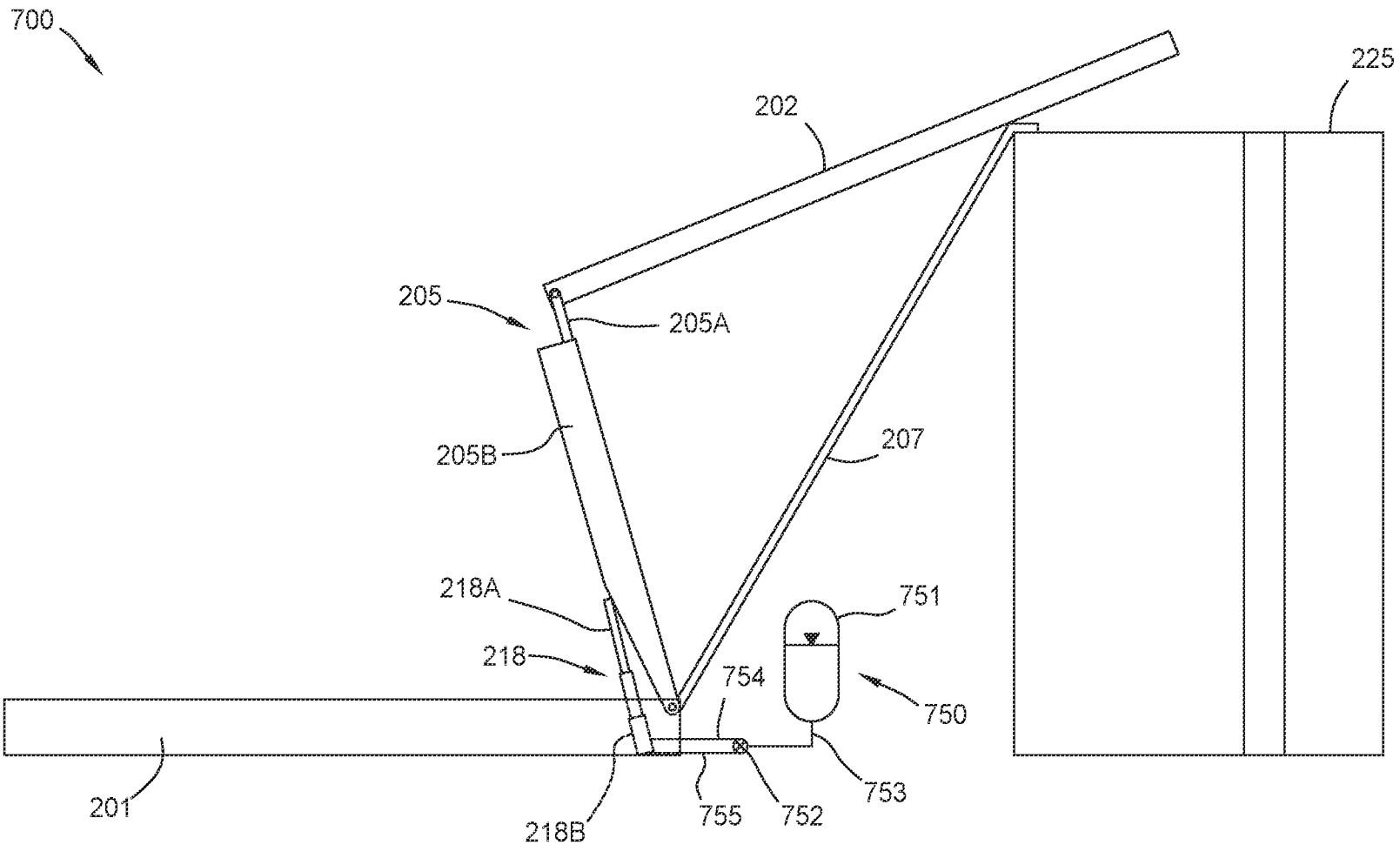
FIG. 7C is a partial schematic side view of the catwalk system shown in FIGS. 7A and 7B, according to one implementation.

FIGS. 7A, 7B, and 7C are partial schematic side views of a catwalk system 700, according to one implementation. The catwalk system 700 is shown in a retracted position in FIG. 7A. The catwalk system 700 is shown in a partially extended position in FIG. 7B. The catwalk system 700 is shown in a fully extended position in FIG. 7C. The catwalk system 700 is similar to the catwalk system 200 shown in FIGS. 2A and 2B and includes one or more of the aspects, features, components, and/or properties thereof.

Although the counterbalance systems are not shown in FIGS. 7A, 7B, and 7C, any of the counterbalance systems and/or biasing systems, such as the counterbalance systems 210, described herein can be used with the catwalk system 700 to help raise the trough 202 along the V-door ramp 207 up to the rig structure 225.

As shown in FIG. 7A, the main arm 205 may be in the form of one or more hydraulic cylinders that include an inner sleeve 205A, which retracts into and extends out of an outer sleeve 205B. An end of the inner sleeve 205A is coupled to the trough 202. As shown in FIG. 7B, when the inner sleeve 205A is retracted into the outer sleeve 205B, the trough 202 begins to move upward and along the V-door ramp 207. One or more additional hydraulic cylinders 218 may be coupled to the main arm 205 and the chassis 201, and are configured to rotate the main arm 205 such that the trough 202 is moved further upward and along the V-door ramp 207. The main arm 205 and the one or more additional hydraulic cylinders 218 may be pivotably coupled to the chassis 201 of the catwalk system 700. The one or more additional hydraulic cylinders 218 may similarly include an inner sleeve 218A that extends out of and retracts into an outer sleeve 218B. An end of the inner sleeve 218A is coupled to the main arm 205. As shown in FIG. 7C, when the inner sleeve 218A is extended out of the outer sleeve 218B, the main arm 205 is rotated and the trough 202 is moved upward and along the V-door ramp 207 to the desired location adjacent to the rig structure 225.

Also shown in FIGS. 7A, 7B, and 7C is an accumulator system 750 that can also be use in addition to or as an alternative to any of the counterbalance systems. The accumulator system 750 includes an accumulator 751, a control valve 752, and one or more fluid lines 753, 754, 755 fluidly coupling the accumulator 751 to the hydraulic cylinders 218. The same or an additional accumulator system may be fluidly coupled to the main arm 205. The accumulator 751 may include a bladder or piston, a gas filled on one side of the bladder or piston, and a hydraulic fluid filled on the opposite side of the bladder or piston. The hydraulic fluid may be supplied to the hydraulic cylinders 218 to actuate the hydraulic cylinders 218, which rotate the main arm 205 to help move the trough 202 upward along the V-door ramp 207. When the trough 202 is lowered downward along the V-door ramp 207, the hydraulic fluid is supplied back into the accumulator 751, which compresses the gas in the accumulator. The force of the compressed gas helps supply the hydraulic fluid back to the hydraulic cylinders 218 to raise the trough 202 again. A control valve 752 is used to control the flow of hydraulic fluid to and from the hydraulic cylinders 218 and the accumulator 751 during operation of the catwalk system 700.

Figure 8A:
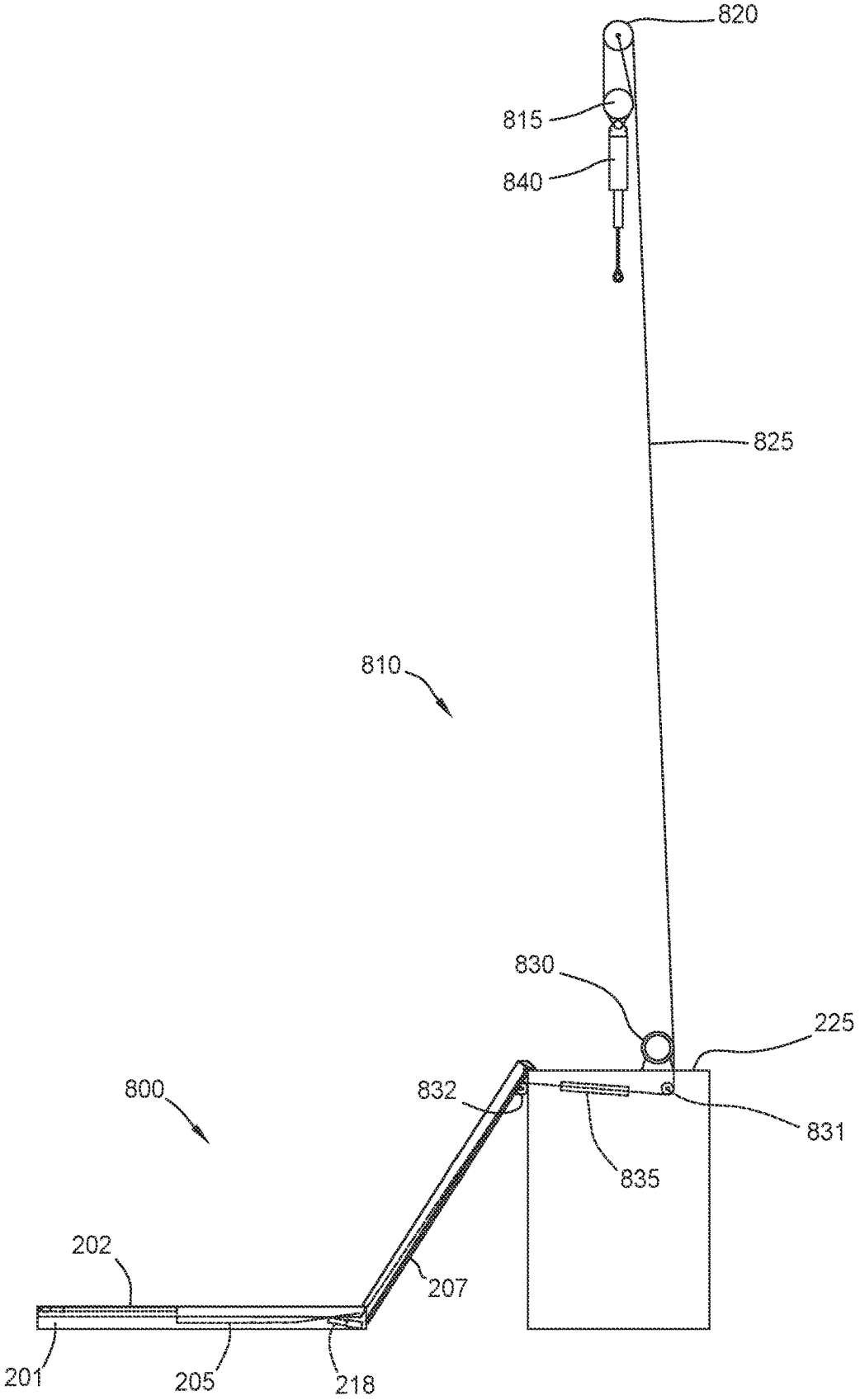
FIG. 8A is a partial schematic side view of a catwalk system, according to one implementation.
Figure 8B:
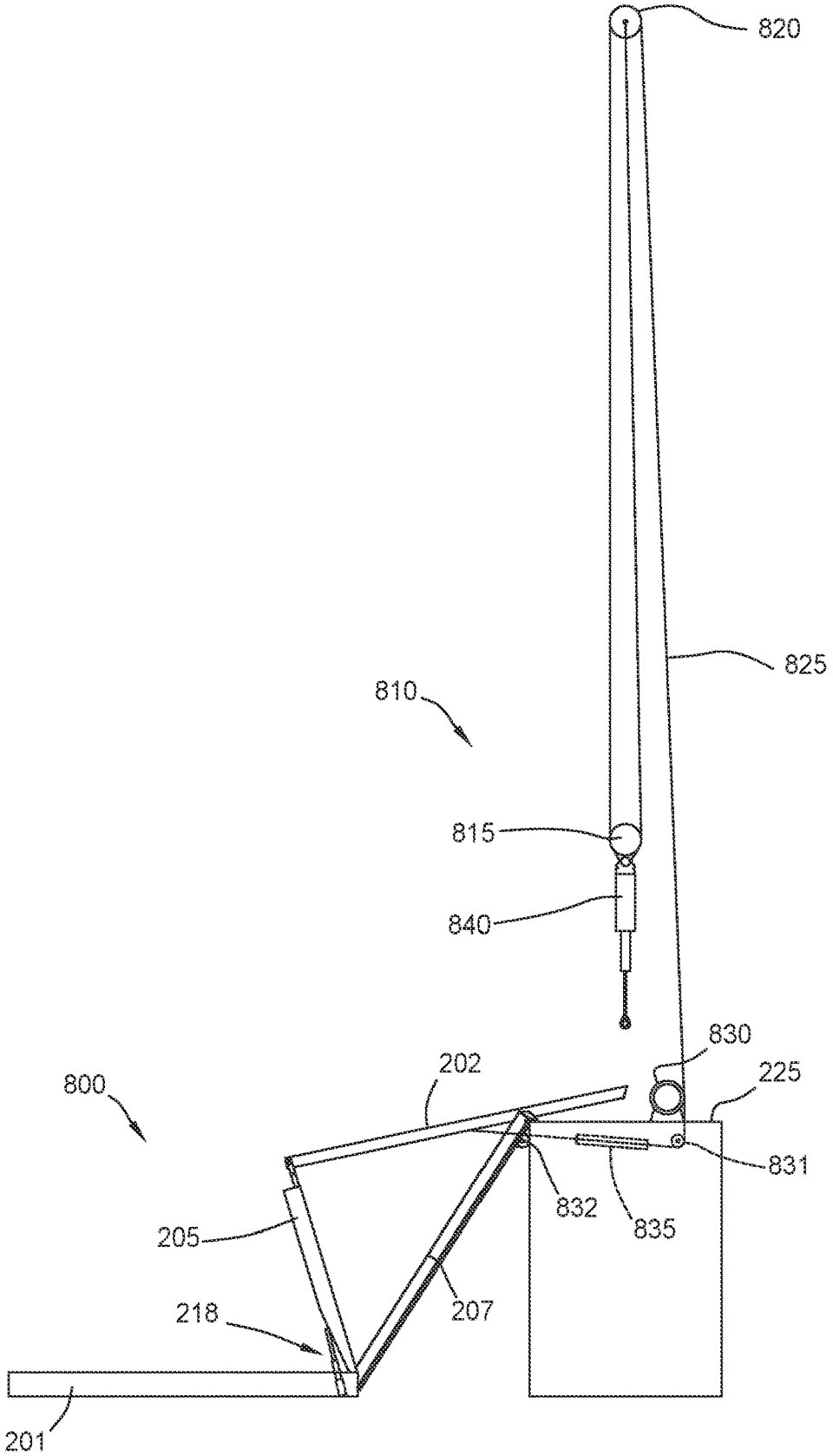
FIG. 8B is a partial schematic side view of the catwalk system shown in FIG. 8A, according to one implementation.

FIGS. 8A and 8B are partial schematic side views of a catwalk system 800 and a counterbalance system 810, according to one implementation. The catwalk system 800 is shown in a retracted position in FIG. 8A. The catwalk system 800 is shown in a fully extended position in FIG. 8B. The catwalk system 800 is similar to the catwalk system 700 shown in FIGS. 7A, 7B, and 7C and includes one or more of the aspects, features, components, and/or properties thereof.

As shown in FIGS. 8A and 8B, the counterbalance system 810 includes using the potential energy of the weight of a top drive system 840 located on the rig structure 225 to help move the trough 202 upward along the V-door ramp 207. One or more cables 825 may be connected at one end to the top drive system 840, and connected at an opposite end to the trough 202. The cables 825 are wound about a drawworks system, such as a winch 830, which controls the direction that the cables 825 are moved to raise and lower the top drive system 840, and thereby lower and raise the trough 202. The cables 825 are looped through a series of sheaves 815, 820, 831, 832 and configured to help raise the trough 202 upward along the V-door ramp 207 when the top drive system 840 is lowered relative to the rig structure 225. The weight of the top drive system 840 acts as a counterbalance force to help pull the trough 202 upward along the V-door ramp 207 with the main arm 205 and/or the one or more additional hydraulic cylinders 218. The cables 825 are also configured to help lower the trough 202 downward along the V-door ramp 207 when the top drive system 840 is raised relative to the rig structure 225. A pulley system 835 may also be connected to the cables 825 to adjust for any change in length of the cables 825 during raising or lowering of the top drive system 840 relative to the catwalk system 800 to ensure a taut connection is maintained between top drive system 840, the cables 825, the winch 830, and the trough 202.

Figure 9:
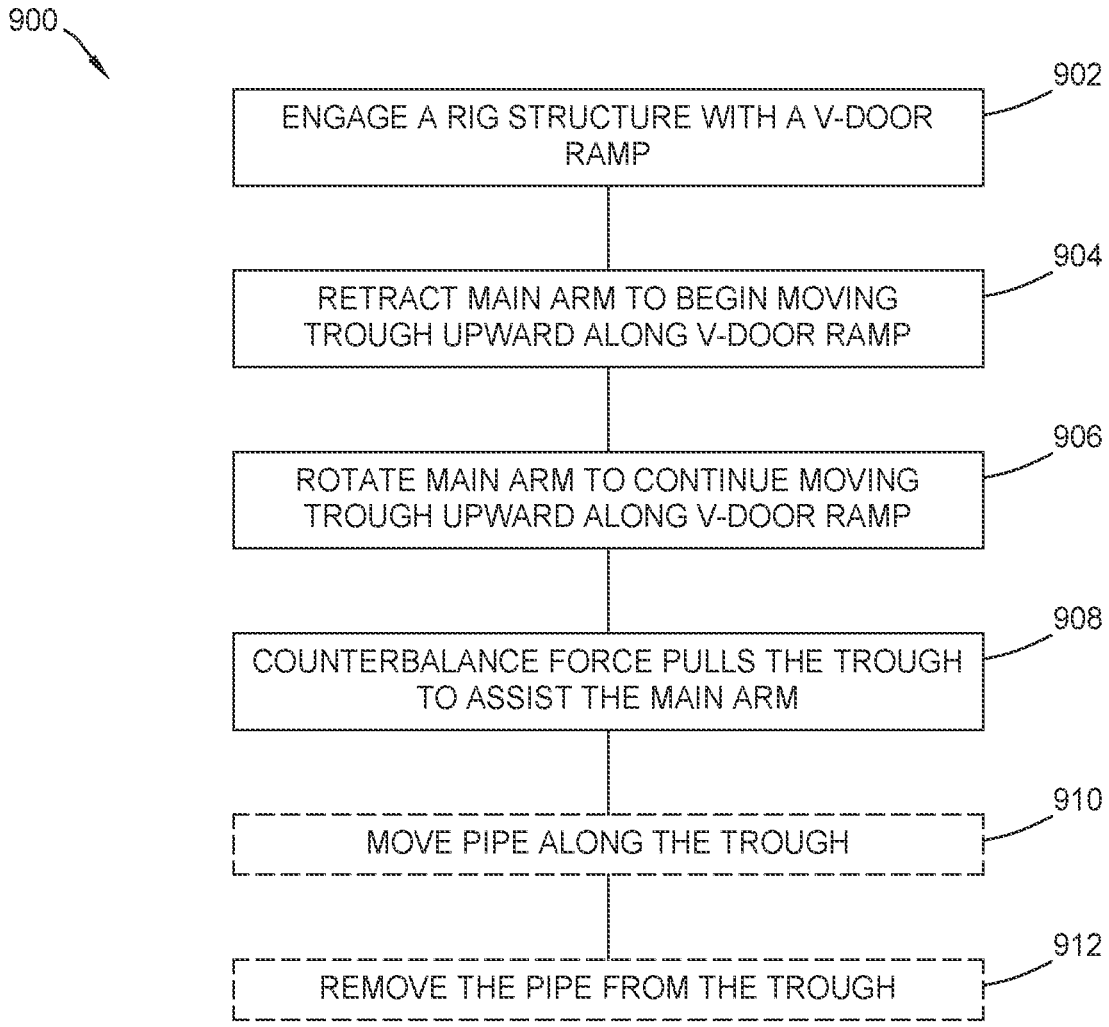
FIG. 9 is a schematic block diagram view of a method of deploying a catwalk system at a wellsite, according to one implementation.

FIG. 9 is a schematic block diagram view of a method 900 of deploying a catwalk system at a wellsite, according to one implementation.

Operation 902 includes engaging a rig structure with a V-door ramp. The V-door ramp is coupled to a counterbalance system. The counterbalance system includes a first sheave suspended from the V-door ramp, a second sheave suspended from the first sheave, and a counterbalance rope wound at least partially about the first sheave and the second sheave. A first end of the counterbalance rope is coupled to a trough at a coupling point. In one embodiment, which can be combined with other embodiments, the counterbalance system includes a third sheave coupled to and suspended from a second end of the counterbalance rope, and a counterweight suspended from the third sheave to weigh the second end of the counterbalance rope. In one example, which can be combined with other examples, the counterweight includes a tank having an internal volume and one or more fluid conduits.

In one embodiment, which can be combined with other embodiments, the internal volume of the tank may be filled with a fluid to a first fill level where an outer end (such as the outer end 209) of the trough moves and/or lifts to disengage from a chassis. The fluid may subsequently be drained from the internal volume of the tank to a second fill level where the outer end of the trough moves and/or lowers to engage the chassis. The second fill level is less than the first fill level. The fluid used to fill the tank may be water or mud (such as drilling mud). The fluid can be any fluid that is used at a wellsite, such as frac fluid.

Operation 904 includes retracting a main arm to begin moving the trough upward and along the V-door ramp toward the rig structure. In one embodiment, which can be combined with other embodiments, the main arm may be in the form of one or more hydraulic cylinders that include an inner sleeve, which retracts into and extends out of an outer sleeve. An end of the inner sleeve is coupled to the trough. As the inner sleeve is retracted into the outer sleeve, the trough is moved upward and along the V-door ramp. In one embodiment, which can be combined with other embodiments, one or more winches, one or more sheaves, and/or one or more wire ropes are used to retract the main arm.

Operation 906 includes rotating the main arm to continue moving the trough upward and along the V-door ramp toward the rig structure. In one embodiment, which can be combined with other embodiments, one or more additional hydraulic cylinders may be coupled to the main arm and are configured to rotate the main arm such that the trough is moved upward and along the V-door ramp. The main arm and the one or more additional hydraulic cylinders may be pivotably coupled to the catwalk. The one or more additional hydraulic cylinders may similarly include an inner sleeve that extends out of and retracts into an outer sleeve. The end(s) of the inner sleeve are coupled to the main arm. As the inner sleeve is extended out of the outer sleeve, the main arm is rotated and the trough is moved upward and along the V-door ramp. In one embodiment, which can be combined with other embodiments, one or more winches, one or more sheaves, and/or one or more wire ropes are used to rotate the main arm.

Operation 908 includes pulling the trough using a counterbalance force of the counterbalance system to assist the main arm and/or the one or more hydraulic cylinders in moving the trough upward and along the V-door ramp. In one embodiment, which can be combined with other embodiments, the pulling of the trough upward and along the V-door ramp using the counterbalance force includes pulling the second end of the counterbalance rope using a weight of the counterweight. In one embodiment, which can be combined with other embodiments, the pulling of the trough upward and along the V-door ramp using the counterbalance force includes biasing a second end of the counterbalance rope using one or more springs. In one embodiment, which can be combined with other embodiments, the pulling of the trough upward and along the V-door ramp using the counterbalance force includes expanding a compressible fluid disposed in a damper chamber against a piston to bias a second end of the counterbalance rope.

The combination of the main arm, the one or more additional hydraulic cylinders, and the counterbalance system moves the trough upward and along the V-door ramp to a desired location adjacent to the rig structure. When the trough is in the desired location, pipe positioned on the trough can be moved onto the rig structure. For example, optional operation 910 includes moving pipe along the trough. In one embodiment, which can be combined with other embodiments, a skate is used to move the pipe along the trough. For example, optional operation 912 includes removing (e.g., lifting) the pipe from the trough. In one embodiment, which can be combined with other embodiments, an elevator is used to remove the pipe from the trough.

Figure 10:
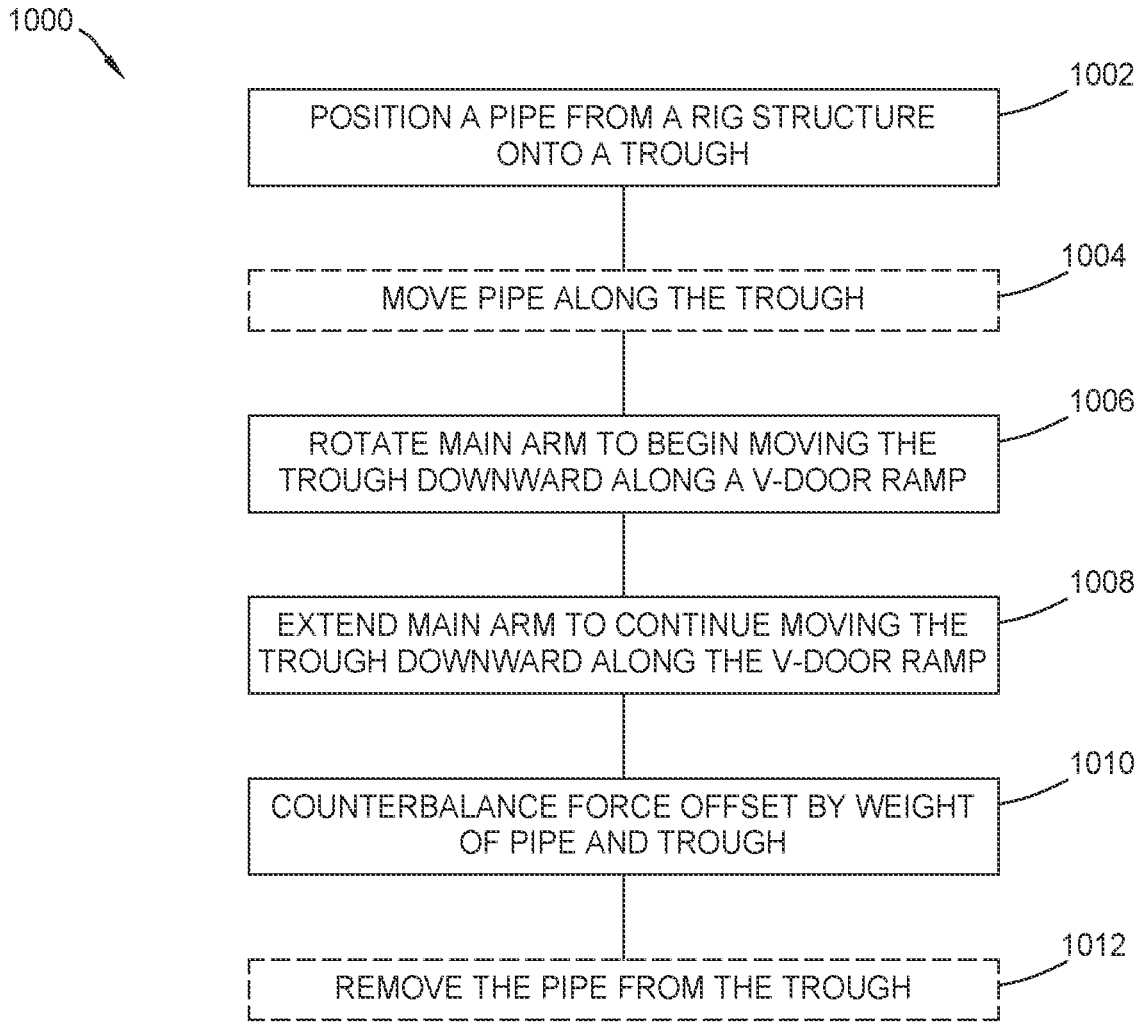
FIG. 10 is a schematic block diagram view of a method of deploying a catwalk system at a wellsite, according to one implementation.

FIG. 10 is a schematic block diagram view of a method 1000 of deploying a catwalk system at a wellsite, according to one implementation.

Optional operation 1002 includes positioning a pipe from a rig structure onto a trough of a catwalk system. In one embodiment, which can be combined with other embodiments, an elevator is used to position the pipe onto the trough.

Optional operation 1004 includes moving the pipe along the trough. In one embodiment, which can be combined with other embodiments, a skate is used to move the pipe along the trough.

Operation 1006 includes rotating a main arm to begin moving the trough downward and along the V-door ramp away from the rig structure. In one embodiment, which can be combined with other embodiments, one or more additional hydraulic cylinders may be coupled to the main arm and are configured to rotate the main arm such that the trough is moved downward and along the V-door ramp. The main arm and the one or more additional hydraulic cylinders may be pivotably coupled to the catwalk. The one or more additional hydraulic cylinders may similarly include an inner sleeve that extends out of and retracts into an outer sleeve. The end(s) of the inner sleeve are coupled to the main arm. As the inner sleeve is retracted into the outer sleeve, the main arm is rotated and the trough is moved downward and along the V-door ramp.

Operation 1008 includes extending the main arm to continue moving the trough downward and along the V-door ramp away from the rig structure. In one embodiment, which can be combined with other embodiments, the main arm may be in the form of one or more hydraulic cylinders that include an inner sleeve, which retracts into and extends out of an outer sleeve. An end of the inner sleeve is coupled to the trough. As the inner sleeve is extended out of the outer sleeve, the trough is moved downward and along the V-door ramp. In one embodiment, which can be combined with other embodiments, one or more winches, one or more sheaves, and/or one or more wire ropes are used to extend the main arm.

Operation 1010 includes offsetting the counterbalance force of the counterbalance system using the weight of the pipe and/or the trough to assist the one or more additional hydraulic cylinders in moving the trough downward and along the V-door ramp.

Optional operation 1012 includes removing the pipe from the trough when moved to the desired location. When the main arm is in the fully extended position, the one or more additional hydraulic cylinders may be in the fully retracted position and the trough may be fully retracted into the chassis of the catwalk system.

Benefits of the present disclosure include saving power, reducing actuation forces needed to convey pipe to a drill floor, saving cost, simply and efficiently opening up availability of power for other wellsite operations, actuating catwalk systems in a modular fashion across a variety of catwalk systems and a variety of wellsites, and reducing operational delays. It is contemplated that one or more of the aspects disclosed herein may be combined. Moreover, it is contemplated that one or more of these aspects may include some or all of the aforementioned benefits.

The present disclosure contemplates that one or more aspects, features, components, and/or properties of the catwalk systems 100, 200, 300, 400, 700, the catwalk system 800, the counterbalance systems 210, 810, the biasing systems 550, 650, the accumulator system 750, and/or the methods 900, 1000 may be combined.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A catwalk system, comprising:
- a chassis;
- a main arm pivotably coupled to the chassis;
- a trough pivotably coupled to the main arm;
- a V-door ramp pivotably coupled to the chassis; and
- a counterbalance system coupled to the trough at a coupling point, the counterbalance system comprising:
  - a first sheave suspended from the V-door ramp,
  - a second sheave independently suspended from the first sheave, and
  - a counterbalance rope wound at least partially about the first sheave and the second sheave, a first end of the counterbalance rope coupled to the trough at the coupling point.

2. The catwalk system of claim 1, wherein the counterbalance system further comprises a trough sheave disposed within the trough between the coupling point and an outer end of the trough.

3. The catwalk system of claim 2, wherein the counterbalance system further comprises a third sheave coupled to and suspended from a second end of the counterbalance rope.

4. The catwalk system of claim 3, wherein the counterbalance system further comprises a counterweight suspended from the third sheave to weigh the second end of the counterbalance rope in a pulling direction.

5. The catwalk system of claim 4, wherein the counterweight comprises a tank having an internal volume and one or more fluid conduits.

6. The catwalk system of claim 5, further comprising one or more counterweight rollers configured to interface between the V-door ramp and the counterweight.

7. The catwalk system of claim 6, wherein the V-door ramp comprises a track configured to retain the counterweight.

8. The catwalk system of claim 1, wherein the counterbalance system further comprises one or more springs configured to bias a second end of the counterbalance rope in a pulling direction.

9. The catwalk system of claim 8, wherein the one or more springs are disposed within the chassis.

10. The catwalk system of claim 1, wherein the counterbalance system further comprises:

a damper chamber disposed within the chassis;

a compressible fluid disposed in the damper chamber; and a damper disposed in the damper chamber and coupled to a second end of the counterbalance rope, the compressible fluid configured to expand to bias the second end of the counterbalance rope in a pulling direction.

11. The catwalk system of claim 10, wherein the damper comprises a piston disposed in the damper chamber, the piston comprising a piston head interfacing with the compressible fluid.

12. A method of deploying a catwalk system at a wellsite, comprising:

engaging a rig structure with a V-door ramp, the V-door ramp coupled to a counterbalance system comprising:

a first sheave suspended from the V-door ramp, a second sheave independently suspended from the first sheave, and a counterbalance rope wound at least partially about the first sheave and the second sheave, a first end of the counterbalance rope coupled to a trough at a coupling point;

actuating a main arm to slide the trough upward and along the V-door ramp toward the rig structure;

pulling the trough upward using the first end of the counterbalance rope while actuating the main arm;

positioning an outer end of the trough adjacent a platform of the rig structure; and pulling the trough downward using the first end of the counterbalance rope.

13. The method of claim 12, wherein the counterbalance system further comprises:

a third sheave coupled to and suspended from a second end of the counterbalance rope; and a counterweight suspended from the third sheave to weigh the second end of the counterbalance rope, the counterweight comprising a tank having an internal volume and one or more fluid conduits.

14. The method of claim 13, further comprising conducting a calibration operation prior to the actuating of the main arm, the calibration operation comprising:

filling the internal volume of the tank with a fluid to a first fill level where an outer end of the trough disengages from a chassis;

draining the fluid from the internal volume of the tank to a second fill level where the outer end of the trough engages the chassis; and stopping the draining of the fluid at the second fill level upon the outer end engaging the chassis.

15. The method of claim 14, wherein the fluid is water or mud.

16. The method of claim 14, wherein the actuating of the main arm is conducted while the internal volume of the tank is filled to the second fill level.

17. The method of claim 16, wherein the pulling of the trough upward comprises pulling the second end of the counterbalance rope using a weight of the counterweight.

18. The method of claim 12, wherein the pulling of the trough upward comprises biasing a second end of the counterbalance rope using one or more springs.

19. The method of claim 12, wherein the pulling of the trough upward comprises expanding a compressible fluid disposed in a damper chamber against a piston to bias a second end of the counterbalance rope.

20. A catwalk system, comprising:

a chassis;

a main arm pivotably coupled to the chassis, the main arm comprising an outer sleeve and an inner sleeve;

a trough pivotably coupled to the inner sleeve of the main arm, wherein the inner sleeve is retractable into and extendable from the outer sleeve to move the trough along the V-door ramp;

a V-door ramp pivotably coupled to the chassis; and a counterbalance system coupled to the trough at a coupling point, the counterbalance system comprising:

an accumulator fluidly coupled to one or more hydraulic cylinders configured to rotate the main arm to move the trough along the V-door ramp, wherein:

when the trough is raised upward along the V-door ramp, the inner sleeve is retracted into the outer sleeve and hydraulic fluid is directed from the accumulator to the one or more hydraulic cylinders to extend the one or more hydraulic cylinders, when the trough is lowered downward along the V-door ramp, the inner sleeve is extended from the outer sleeve and the hydraulic fluid is directed from the one or more hydraulic cylinders to the accumulator to retract the one or more hydraulic cylinders, which compresses a gas in the accumulator, and a force of the compressed gas forces the hydraulic fluid back to the one or more hydraulic cylinders to help raise the trough.

21. A catwalk system, comprising:

a chassis;

a main arm pivotably coupled to the chassis;

a trough pivotably coupled to the main arm;

a V-door ramp pivotably coupled to the chassis; and a counterbalance system coupled to the trough at a coupling point, the counterbalance system comprising:

a plurality of sheaves;

a counterbalance rope wound at least partially about the plurality of sheaves, wherein a first end of the counterbalance rope is coupled to the trough, wherein a second end of the counterbalance rope is coupled to a top drive system and wound about a drawworks system configured to raise and lower the top drive system, and wherein when the top drive system is lowered, the trough is moved upward along the V-door ramp such that the weight of the top drive system acts as a counterbalance force to help pull the trough upward along the V-door ramp.

* * * * *